US006717372B2

(12) United States Patent
Lin et al.

(10) Patent No.: US 6,717,372 B2
(45) Date of Patent: Apr. 6, 2004

(54) MULTI-LAMP DRIVING SYSTEM

(75) Inventors: Wei-Hong Lin, Hsinchu (TW); Chia-Yuan Chen, Hsinchu (TW); Deng-Kang Chang, Hsinchu (TW); Cheng-Chia Hsu, Hsinchu (TW)

(73) Assignee: Ambit Microsystems Corp., Hsinchu (TW)

( * ) Notice: Subject to any disclaimer, the term of this patent is extended or adjusted under 35 U.S.C. 154(b) by 12 days.

(21) Appl. No.: 10/081,371

(22) Filed: Feb. 22, 2002

(65) Prior Publication Data

US 2003/0001524 A1 Jan. 2, 2003

(30) Foreign Application Priority Data

Jun. 29, 2001 (TW) ..... 90116064 A

(51) Int. Cl.[7] ..... H05B 41/16; H05F 17/04

(52) U.S. Cl. ..... 315/282; 315/274; 315/276; 315/224; 336/221; 336/213; 336/225

(58) Field of Search ..... 315/224, 225, 315/291, 307, 246, 276, 277, 282, 312, 274; 336/221, 213, 225, 220

(56) References Cited

U.S. PATENT DOCUMENTS 6,028,400 A * 2/2000 Pol et al. ..... 315/225
6,104,146 A * 8/2000 Chou et al. ..... 315/277
6,323,602 B1 * 11/2001 De Groot et al. ..... 315/276
6,362,577 B1 * 3/2002 Ito et al. ..... 315/289

* cited by examiner

*Primary Examiner*—Tuyet T. Vo
(74) *Attorney, Agent, or Firm*—Ladas & Parry

(57) ABSTRACT

A multi-lamp system for driving a lamp set having a first lamp and a second lamp comprises a driving circuit for converting a DC signal to an AC signal, a transformer having a primary side coupled to the driving circuit and a secondary side for outputting the AC power, and a current balance circuit coupled to the low voltage terminal of the lamp set for balancing the current values flowing through the first lamp and the second lamp. The current balance circuit comprises a magnetic core, a first winding coupled to the first lamp and a second winding coupled to the second lamp. The first winding and the second winding are wound on the magnetic core and have the same coil number.

17 Claims, 7 Drawing Sheets

MULTI-LAMP DRIVING SYSTEM

BACKGROUND OF THE INVENTION

1. Field of the Invention

The present invention relates in general to a driving system for a discharge tube. In particular, the present invention relates to a multi-lamp driving system for a liquid crystal display backlight.

2. Description of the Related Art

A discharge tube, particularly a cold cathode fluorescent lamp, CCFL), is used as the light source for LCD backlight systems. The CCFL is typically driven by an inverter circuit, which provides DC current to a lamp and includes a feedback and control loop for stabilizing lamp currents. A large LCD panel usually requires two or more fluorescent lamps to provide sufficient backlighting.

FIG. 1 (Prior Art) is a multi-lamp driving system in a conventional device. The system includes a driving circuit 10 and a transformer T1 for driving two fluorescent lamps LP1 and LP2, and has one feedback and control circuit 30. The impedance difference of the lamps seriously influences the currents I1 and I2 though the lamps and therefore unbalances the distribution of the currents. However, the circuit in the FIG. 1 only controls the total current of the lamps LP1 and LP2 and fails to balance the current through each of the lamps. The imbalance not only affects the illumination uniformity of the LCD panel due to insufficient luminance of those lamps having too small currents, but also shortens the life of individual lights and the backlight system due to overheat of those lamps having too large current.

In order to overcome the above disadvantage, some schemes using several driving circuits and transformers to drive a plurality of lamps and provide several feedback and control circuits for current regulation are proposed. As shown in FIG. 2, driving circuits 10,20 and transformers T1 and T2 are provided to drive lamps LP1 and LP2. In addition, the lamps LP1 and LP2 are connected to feedback and control circuits 30 and 40. This scheme balances the currents of lamps I1 and I2, but requires more components and increases fabrication costs and product size.

Therefore, it is necessary to provide a circuit balance technique for multi-lamp driving systems to solve the above problems.

SUMMARY OF THE INVENTION

An object of the present invention is to provide a multi-lamp driving system, which directly controls the current balance among lamps.

Another object of the present invention is to provide a low-cost, small-scale multi-lamp driving system.

The multi-lamp driving system of the present invention is used to drive a lamp set having a first lamp and a second lamp. It comprises a driving circuit for converting a DC (Direct Current) signal to an AC (Alternating Current) signal, a transformer having a primary side coupled to the driving circuit and a secondary side to output AC signal, and a current balance circuit coupled to the lamp set to balance the currents flowing through the first lamp and the second lamp. The current balance circuit comprises a magnetic core, a first winding connected to the first lamp and a second winding connected to the second lamp. The first winding and the second winding are wound on the magnetic core and have the same number of turns. The current balance circuit is coupled to a high voltage terminal or low voltage terminal in the lamp set based on various applications.

Optionally, the multi-lamp driving system of the present invention further comprises a feedback and control circuit, such as a pulse-width-modulation controller, for controlling the driving circuit according to the current values of the lamp set.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

Figure 1:
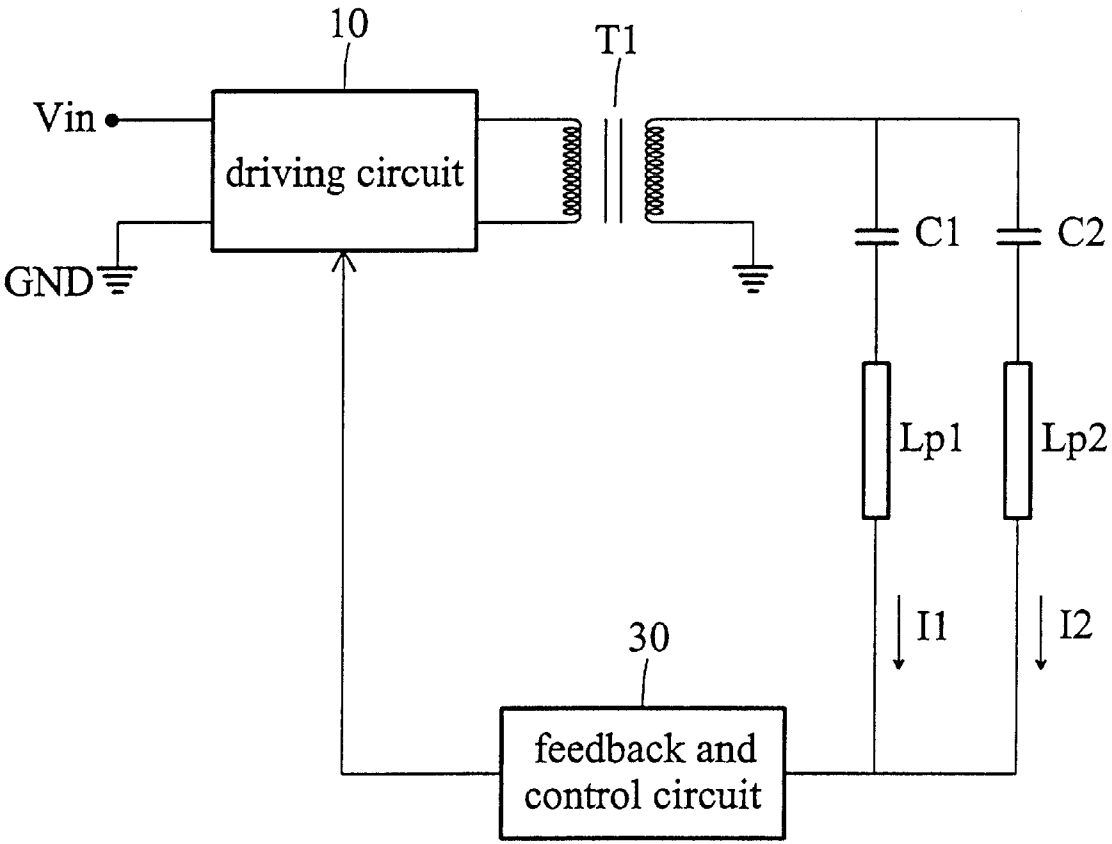
FIG. 1 (PRIOR ART)
FIG. 1 (Prior Art) is a circuit diagram of the multi-lamp driving system in the prior art.
Figure 2:
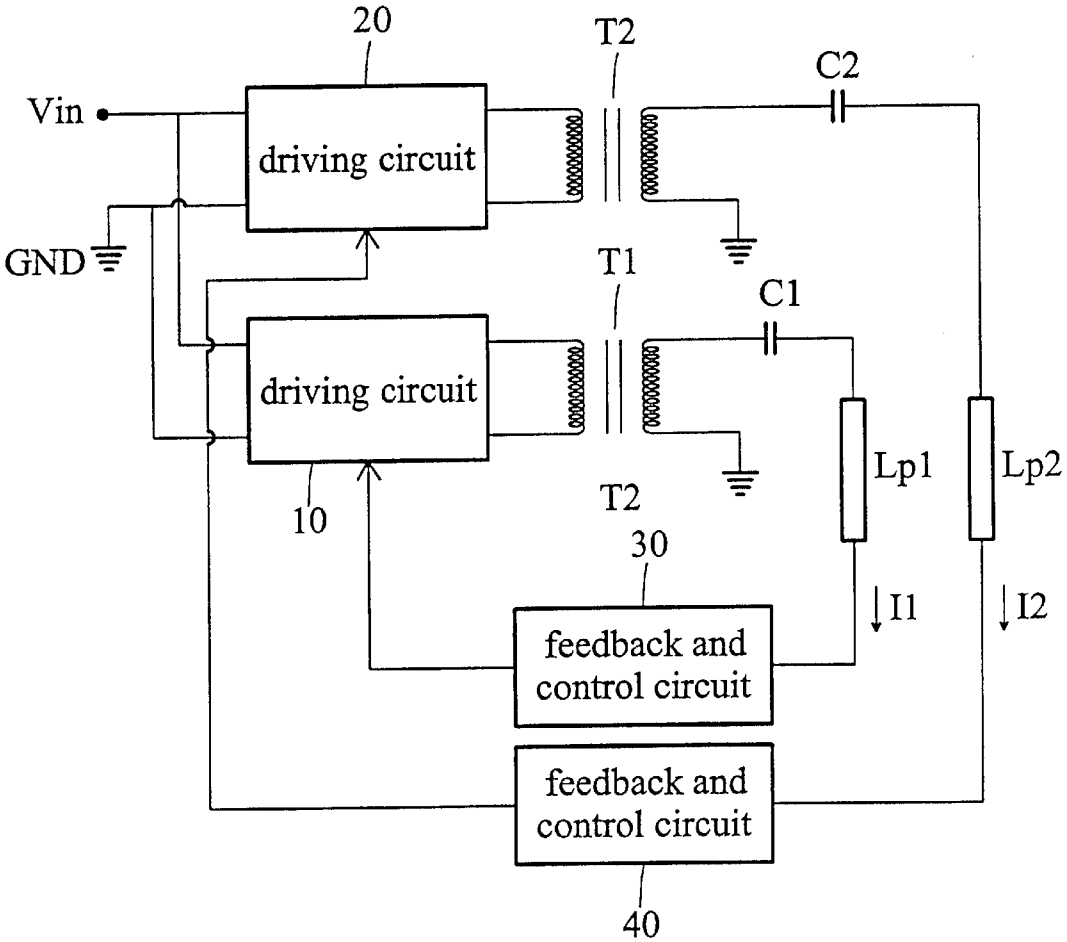
FIG. 2 (PRIOR ART)
FIG. 2 (Prior Art) is a circuit diagram of the multi-lamp driving system in another scheme from the prior art.
Figure 3:
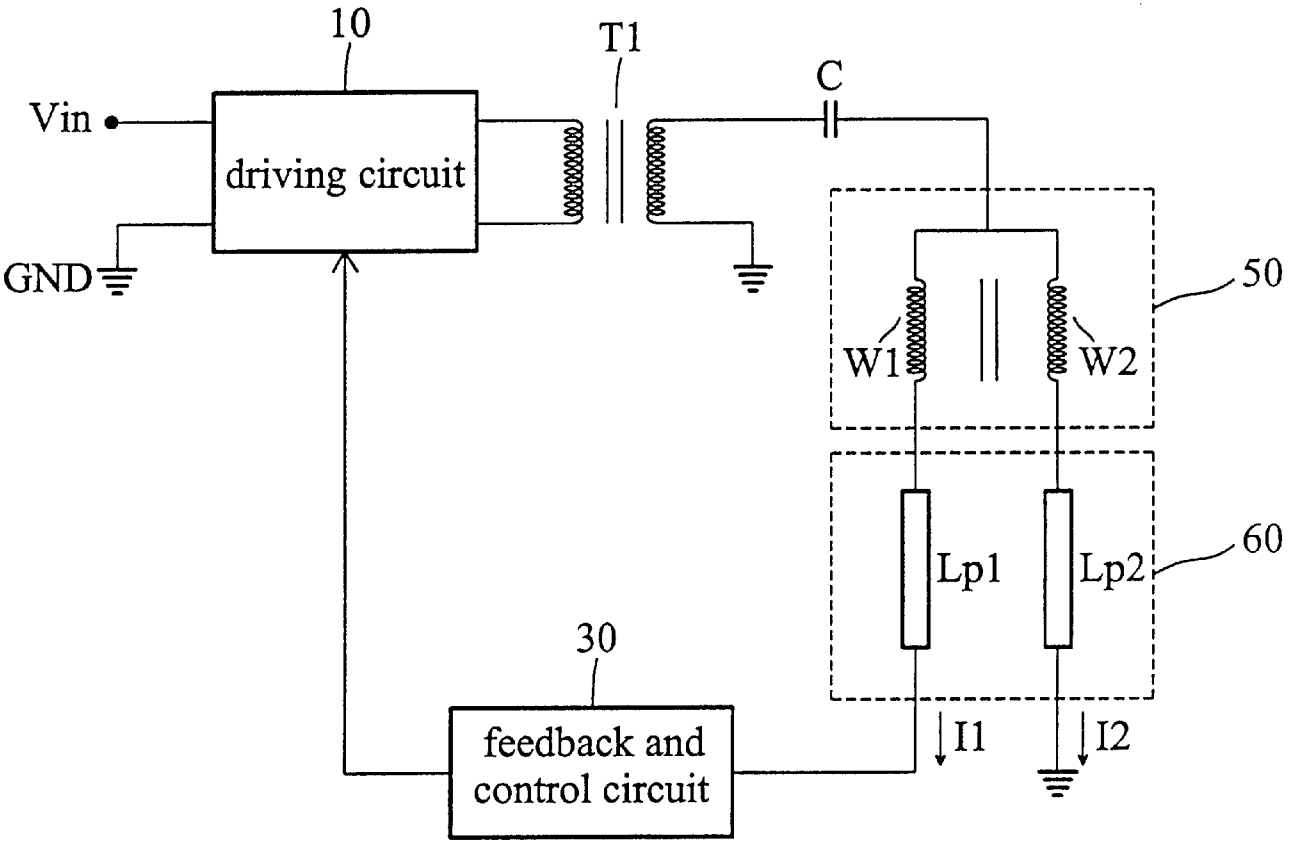
FIG. 3 is a circuit diagram of the multi-lamp driving system in accordance with the first embodiment of the present invention.

FIG. 3 shows a circuit diagram of the multi-lamp driving system in accordance with the first embodiment of the present invention. Referring to FIG. 3, according to the first embodiment of the invention, the multi-lamp driving system comprises a driving circuit 10, a transformer T1, a lamp set 60, a current balance circuit 50, and a feedback and control circuit 30. The driving circuit 10 is coupled to the primary side of the transformer T1 to form an inverter circuit. The driving circuit 10 receives input from a DC power source Vin and converting the DC signal to AC signal. Then, the transformer T1 steps up the voltage of the AC signal and output it from the secondary side to provide the power for the lamp set 60. The lamp set 60 comprises a first lamp LP1 and a secondary lamp LP2. The current balance circuit 50, coupled to a high voltage side of the combined lamp 60, comprises a first winding W1 connected to the first lamp LP1 and a second winding W2 connected to the second lamp LP2. The first winding W1 and the second winding W2 are wound on the same magnetic core and form a structure similar to a transformer. The coil number of the winding W1 is equal to that of the winding W2. The transformer with coil number ratio of 1:1 ensures that the voltages across/currents through the two windings equal to each other. Thus, balance between the current I1 of the lamp LP1 and the current I2 of the lamp LP2 is achieved. The feedback and control circuit 30 is connected between the low voltage side of the first lamp LP1 and the driving circuit 10. It controls the driving circuit 10 according to the feedback current from the first lamp LP1. The feedback and control circuit 30 is, for example, a pulse width modulation (PWM) controller.

Figure 4:
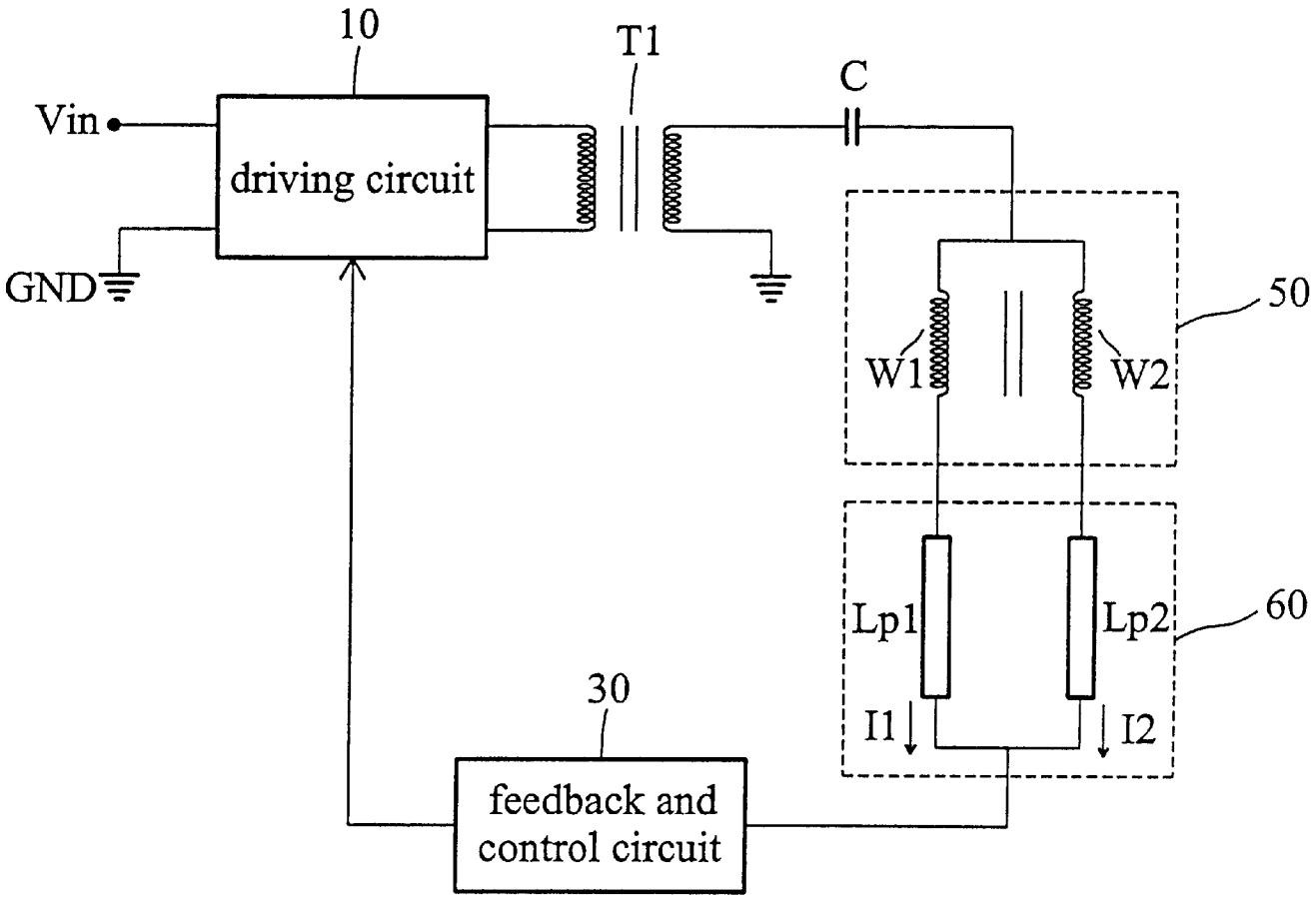
FIG. 4 is a circuit diagram of the multi-lamp driving system in accordance with the second embodiment of the present invention.

FIG. 4 shows a circuit diagram of the multi-lamp driving system in accordance with the second embodiment of the present invention. FIG. 4 is basically the same as FIG. 3 of the first embodiment, with the difference that the low voltage terminal of the first lamp LP1 is connected to the low voltage terminal of the second lamp LP2. As well, the feedback and control circuit 30 controls the driving circuit according to the total feedback current of the lamp LP1 and the lamp LP2.

Figure 5:
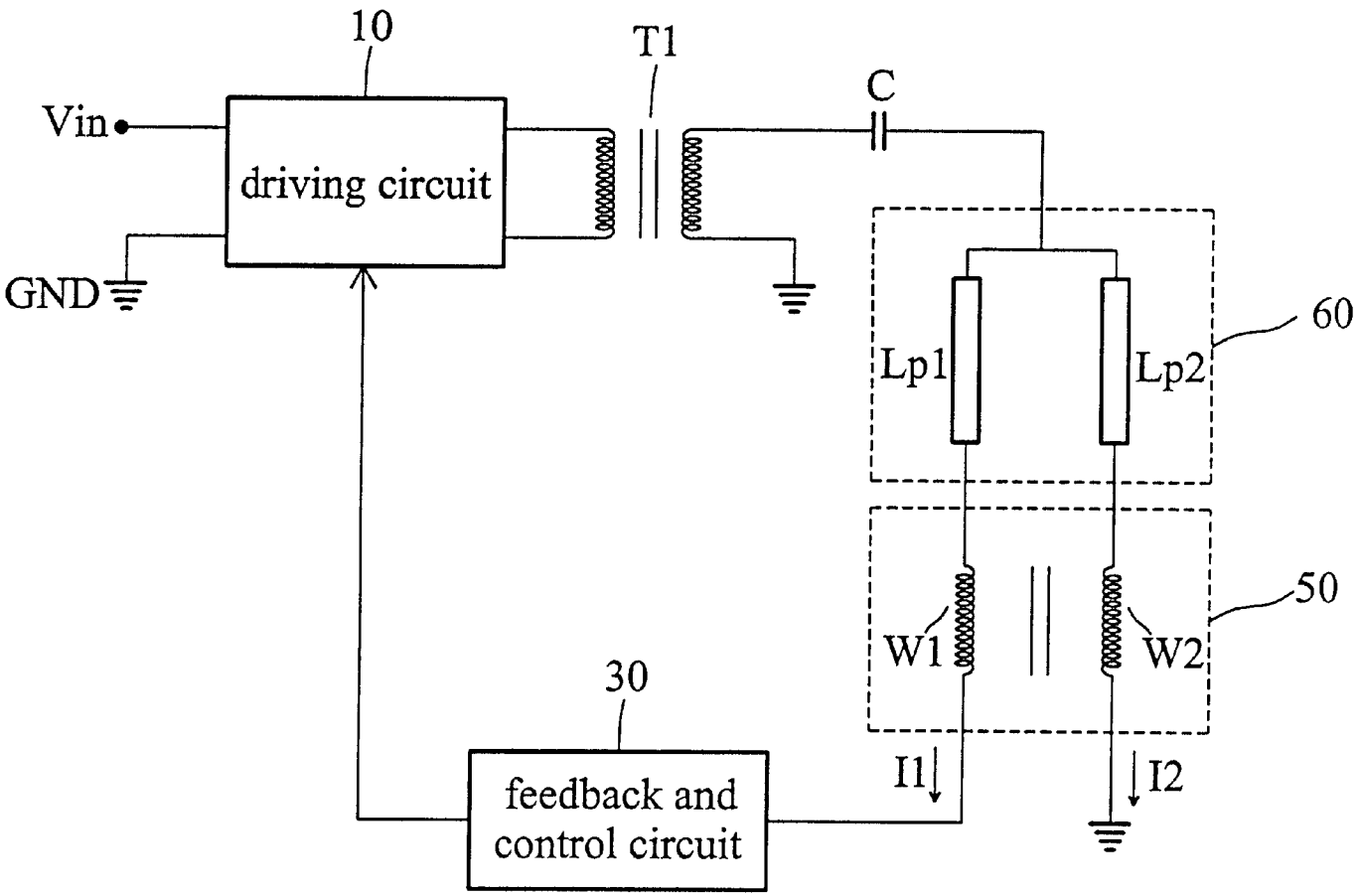
FIG. 5 is a circuit diagram of the multi-lamp driving system in accordance with the third embodiment of the present invention.

FIG. 5 shows a circuit diagram of the multi-lamp driving system in accordance with the third embodiment of the present invention. Unlike FIG. 3 of the first embodiment, the current balance circuit is connected between the low voltage side of the lamp set 60 and the feedback and loop circuit 30 in the circuit of FIG. 5. The basic way of operation and the principle and the effect of the current balance are essentially the same as those of the circuit in FIG. 3.

The multi-lamp driving system with the current balance circuit of the present invention is not only used for the above two-lamp application but also for multi-lamp applications.

Figure 6:
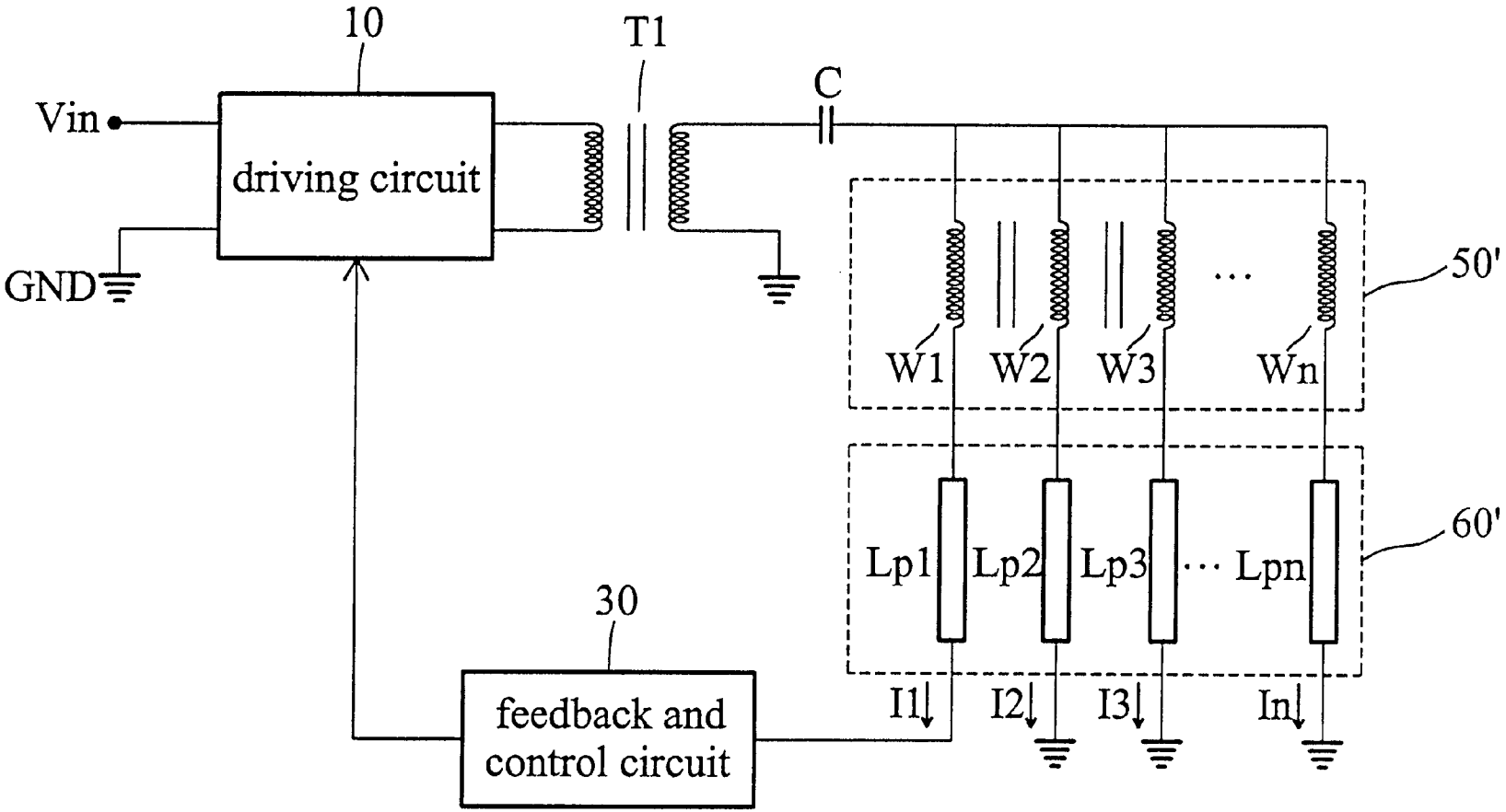
FIG. 6 is a circuit diagram of the multi-lamp driving system in accordance with the fourth embodiment of the present invention.

FIG. 6 shows a circuit diagram of the multi-lamp driving system in accordance with the fourth embodiment of the present invention. It is used to drive any number of lamps LP1~LPn. In the embodiment, the current balance circuit 50 comprises a plurality of windings W1~Wn coupled to the high voltage sides of a plurality of lamps LP1~LPn in the lamp set 60. The windings W1~Wn are wound on the same magnetic core and have the same winding number. Because all the currents flowing through the windings W1~Wn are consequentially equal, balance among the currents I1~In of the lights I1~In is achieved.

Figure 7:
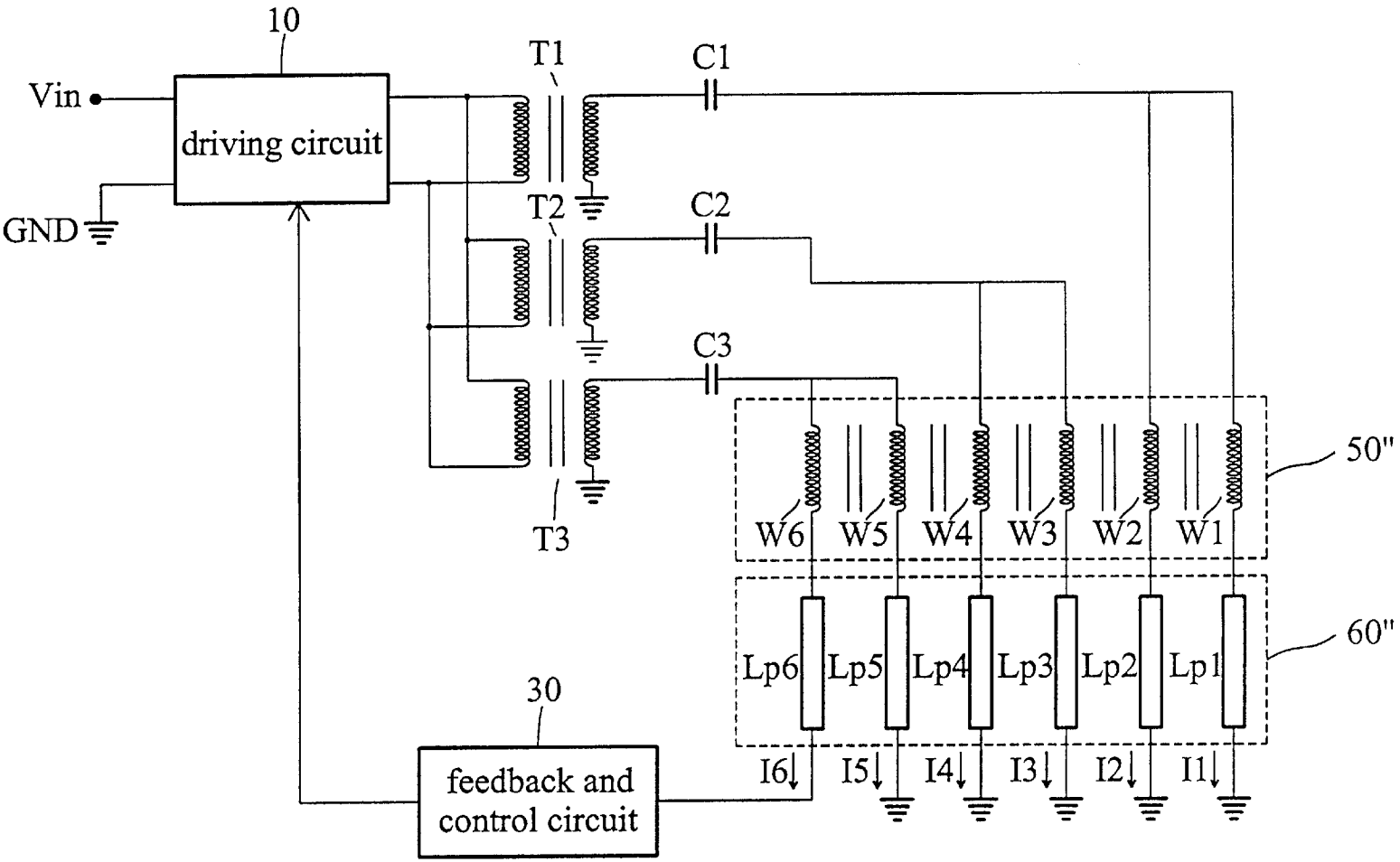
FIG. 7 is a circuit diagram of the multi-lamp driving system in accordance with the fifth embodiment of the present invention.

FIG. 7 shows a circuit diagram of the multi-lamp driving system in accordance with the fifth embodiment of the present invention. In applications with large numbers of lamps, because of the power rating of the transformer and other considerations on the manufacturing cost or circuit design, more than one transformer are used. For example, in the circuit shown in FIG. 7, three transformers T1–T3 are used to drive six lamps Lp1~Lp6, in which each of the transformers is used to drive two of the lamps. Each of the high voltage terminals of the lamps Lp1~Lp6 is coupled to one of the windings W1~W6. As well, the windings W1~W6 are coupled to each other, and wound on the same magnetic core. Thereby, balance among the currents I1~I6 of the lamps Lp1~Lp6 is achieved. As in the embodiment shown in FIG. 5, the current balance circuit 50 may also be designed to connect to the low voltage side of the lamp set 60.

Finally, while the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A multi-lamp driving system for driving a lamp set having a first lamp and a second lamp, comprising:

a power supply circuit for supplying the lamp set with AC power; and a current balance circuit coupled between a secondary side of a transformer and a high voltage terminal of the lamp set for balancing the current values through the first lamp and the second lamp;

wherein the current balance circuit comprises a magnetic core, a first winding electrically coupled to the first lamp, and a second winding electrically coupled to the second lamp, and the first winding and the second winding are wound on the magnetic core and the coil number of the first winding is equal to that of the second winding.

2. The multi-lamp driving system as claimed in claim 1, wherein the power supply circuit comprises a driving circuit for converting a DC signal to an AC signal and a transformer having a primary side coupled to the driving circuit and a secondary side for outputting the AC power.

3. The multi-lamp driving system in claim 1, wherein the current balance circuit is coupled to a high voltage terminal of the lamp set.

4. The multi-lamp driving system in claim 1, wherein the current balance circuit is coupled to a low voltage terminal of the lamp set.

5. The multi-lamp driving system as claimed in claim 1, wherein the current balance circuit unifies the current values through the first lamp and the second lamp.

6. The multi-lamp driving system as claimed in claim 1, further comprising a feedback and control circuit for controlling the power supply circuit according to the current values of the lamp set.

7. The multi-lamp driving system in claim 6, wherein the feedback and control circuit is a pulse-width-modulation controller.

8. A multi-lamp driving system for driving a lamp set having a first lamp and a second lamp, the lamp set having a high voltage terminal and a low voltage terminal, the multi-lamp driving system comprising:

a driving circuit for converting a DC signal to a AC signal;

a transformer having a primary side coupled to the driving circuit; and a current balance circuit electrically coupled between a secondary side of the transformer and the high voltage terminal of the lamp set for balancing the current values flowing through the first lamp and the second lamp;

wherein the current balance circuit comprises a magnetic core, a first winding coupled to the first lamp and a second winding coupled to the second lamp, and the first winding and the second winding are wound on the magnetic core and the coil number of the first winding is equal to that of the second winding.

9. The multi-lamp driving system as claimed in claim 8, further comprising a feedback and control circuit electrically coupled between the low voltage terminal of the lamp set and the driving circuit, for controlling the driving circuit according to the current values of the lamp set.

10. The multi-lamp driving circuit in claim 9, wherein the feedback and control circuit is a pulse-width-modulation controller.

11. A multi-lamp driving system for driving a lamp set having a plurality of lamps, comprising:

a power supply circuit for supplying the lamp set with AC power; and a current balance circuit electrically coupled between a secondary side of a transformer and a high voltage terminal of the lamp set, for balancing the current values flowing through the lamps;

wherein the current balance circuit comprises a magnetic core and a plurality of windings, each of the windings is electrically coupled to each of the lamps, and each of the windings is wound on the magnetic core with the same coil number.

12. The multi-lamp driving system as claimed in claim 11, wherein the power supply circuit comprises a driving circuit for converting a DC signal to an AC signal and a transformer having a primary side electrically coupled to the driving circuit and a secondary side for outputting the AC power.

13. The multi-lamp driving system in claim 11, wherein the current balance circuit is coupled to a high voltage terminal of the lamp set.

14. The multi-lamp driving system in claim 11, wherein the current balance circuit is coupled to a low voltage terminal of the lamp set.

15. The multi-lamp driving system as claimed in claim 11, wherein the power supply circuit comprises a driving circuit for converting a DC signal to an AC signal and a plurality of transformers, each of the transformers having a primary side electrically coupled to the driving circuit and a secondary side for outputting AC power.

16. The multi-lamp driving system as claimed in claim 11, further comprising a feedback and control circuit for controlling the power supply circuit according to the current values of the lamp set.

17. The multi-lamp driving system in claim 16, wherein the feedback and control circuit is a pulse-width-modulation controller.

* * * * *